US007029039B2

(12) United States Patent
Rathmann et al.

(10) Patent No.: US 7,029,039 B2
(45) Date of Patent: Apr. 18, 2006

(54) METHOD FOR ACTUATING A PAWL IN A LOCK WITH A ROTARY LATCH FOR A MOTOR VEHICLE

(75) Inventors: Klaus-Peter Rathmann, Frankfurt (DE); Axel Schaefer, Hattersheim (DE)

(73) Assignee: Siemens AG, München (DE)

( * ) Notice: Subject to any disclaimer, the term of this patent is extended or adjusted under 35 U.S.C. 154(b) by 0 days.

(21) Appl. No.: 11/030,984

(22) Filed: Jan. 10, 2005

(65) Prior Publication Data

US 2005/0145740 A1 Jul. 7, 2005

Related U.S. Application Data

(63) Continuation of application No. PCT/DE03/03260, filed on Sep. 30, 2003.

(30) Foreign Application Priority Data

Nov. 1, 2002 (DE) ..... 102 51 382

(51) Int. Cl.
*E05C 3/06* (2006.01)

(52) U.S. Cl. ..... 292/199; 70/256

(58) Field of Classification Search ..... 292/199, 292/201, 216, 336.3, DIG. 23; 70/262–264, 70/256, 257, 259, 277–279
See application file for complete search history.

(56) References Cited

U.S. PATENT DOCUMENTS 4,518,181 A * 5/1985 Yamada ..... 292/201
4,763,936 A * 8/1988 Rogakos et al. ..... 292/201
4,986,579 A * 1/1991 Ishikawa ..... 292/201
5,180,198 A * 1/1993 Nakamura et al. ..... 292/201
5,236,234 A * 8/1993 Norman ..... 292/201
5,765,884 A * 6/1998 Armbruster ..... 292/216
6,056,334 A 5/2000 Petzold et al.
6,435,573 B1 * 8/2002 Szablewski ..... 292/201
6,519,986 B1 * 2/2003 Wicker ..... 70/237
6,629,710 B1 * 10/2003 Shafry et al. ..... 292/216
6,705,649 B1 * 3/2004 Reddmann ..... 292/216

FOREIGN PATENT DOCUMENTS

DE 19600524 A1 6/1997

(Continued)

OTHER PUBLICATIONS

Derwent Abstract—DE-19710531A1; Sep. 17, 1998; Robert Bosch GmbH, D-70469 Stuttgart (Germany).

(Continued)

*Primary Examiner*—Emmanuel M Marcelo
(74) *Attorney, Agent, or Firm*—Jacob Eisenberg; Siemens AG

(57) ABSTRACT

According to the inventive method, a pawl which in a normal mode of operation is rotatably mounted about a point of rotation when it is in a closed position can be rotated by means of a first actuator, which is controlled by a main power supply and by means of a toothed gearwheel segment which is also rotatably mounted about said point of rotation and which can run freely in relation to the pawl, until an open position is obtained. In the event of an emergency, the pawl can be rotated by means of a second self-inhibiting actuator, which is controlled by the emergency power supply, by means of another rotatably mounted toothed gearwheel segment which comprises a toothed gearwheel having a smaller diameter and which engages with the toothed wheel segment, until an open position is obtained. The emergency power supply is then interrupted and the pawl is maintained in an open position.

3 Claims, 1 Drawing Sheet

FOREIGN PATENT DOCUMENTS

| | | | |
|---|---|---|---|
| DE | 19706657 | A1 | 8/1998 |
| DE | 19710531 | A1 | 9/1998 |
| DE | 19756266 | A1 | 6/1999 |
| DE | 19924447 | A1 | 10/2000 |
| DE | 10100010 | A1 | 7/2002 |

OTHER PUBLICATIONS

Derwent Abstract—DE-19706657A1; Aug. 27, 1998; Mannesmann VDO AG, D-60388 Frankfurt (Germany).

Derwent Abstract—DE-19600524A1; Jun. 26, 1997; VDO Adolf Schindling AG, D-60326 Frankfurt (Germany).

Derwent Abstract—DE-19756266A1; Jun. 24, 1999; Mannesmann VDO AG, D-60388 Frankfurt (Germany).

Derwent Abstract—DE-10100010A1; Jul. 1, 2002; Robert Bosch GmbH, D-70469 Stuttgart (Germany).

Derwent Abstract—DE-19924447; Oct. 26, 2000; Robert Bosch GmbH, D-70469 Stuttgart (Germany).

* cited by examiner

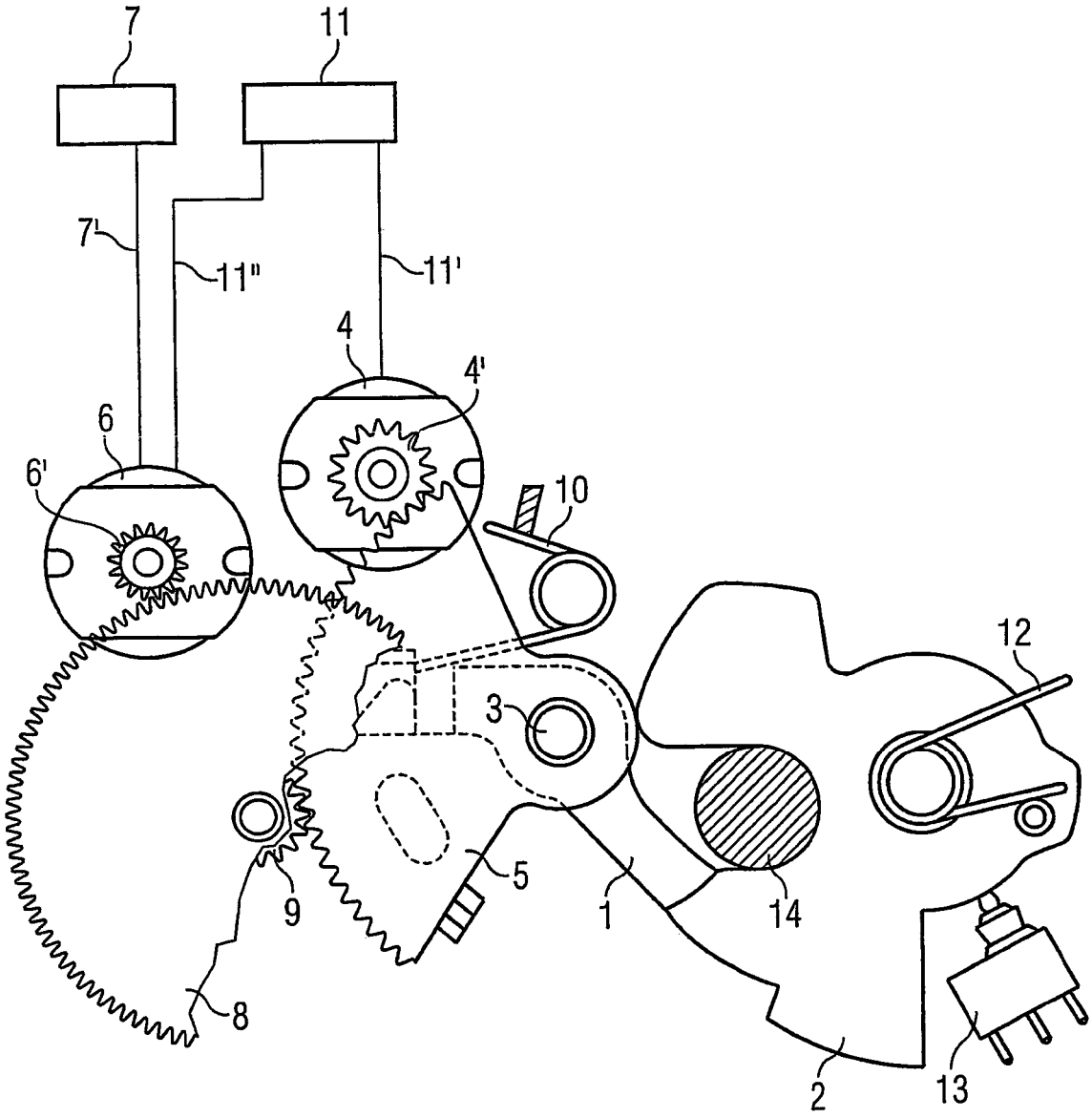
7
11
7'
11"
11'
4
4'
6
6'
10
12
3
5
9
1
14
8
2
13

METHOD FOR ACTUATING A PAWL IN A LOCK WITH A ROTARY LATCH FOR A MOTOR VEHICLE

CROSS REFERENCE TO RELATED APPLICATIONS

The present application is a continuation of international application PCT/DE03/03260, filed Sep. 30, 2003, and claims priority to German application 10251382.1, filed Nov. 1, 2002, the both of which are herein incorporated by reference.

BACKGROUND OF THE INVENTION

The invention relates to a method for actuating a pawl in a lock with a rotary latch for a motor vehicle. Methods for actuating pawls in motor vehicle locks are known. DE 197 06 657 A1 describes a lock for a movable arrangement, such as a door, tailgate or the like, of a vehicle having an actuator for driving a pawl, in which a further actuator is provided for the direct or indirect driving of the pawl. Provision is made here, when the pawl is actuated, for the pawl to be brought back into the starting position by means of spring loading or by reversing the direction of rotation of the actuator. However, this may be disadvantageous in the event of an emergency.

SUMMARY OF THE INVENTION

The invention is therefore based on the object of providing a method for actuating a pawl in a lock with a rotary latch for a motor vehicle, in which the actuators used are supplied with power both in the normal situation and in the event of an emergency in such a manner that, with comfort taken into consideration, relatively stringent safety precautions are satisfied.

The object on which the invention is based is achieved by a method for actuating a pawl in a lock with a rotary latch for a motor vehicle, in which, in the normal situation, the pawl, which is in the closed position and is mounted rotatably about a pivot, is caused to rotate by a first actuator, which is activated by a main power supply, and by a gearwheel segment, which is likewise mounted rotatably about the pivot and runs freely in relation to the pawl, until the open position is reached, or, in the event of an emergency, is caused to rotate by a second, self-locking actuator, which is activated by an emergency power supply, via a further, rotatably mounted gearwheel segment which bears a gearwheel having a smaller diameter and which engages in the gearwheel segment, until the open position is reached and then the emergency power supply is interrupted and the pawl remains in the open position. Electric motors may be used as the first actuator and as the second, self-locking actuator. In this case, it is also possible for a self-locking actuator to also be used as the first actuator. If the pawl is in the closed position, then it engages directly in the rotary latch, as a result of which the lock remains locked. After the emergency power supply is interrupted, the pawl remains in the open position. This takes place by the self-locking action of the second, self-locking actuator. It has surprisingly been shown that particularly stringent safety precautions in the event of an emergency can be set in a relatively simple manner by the pawl remaining in the open position. This applies to the entire time in which only the emergency power supply is available for the lock with the emergency latch for a motor vehicle. A disadvantageous sliding of the pawl back into the starting position is advantageously avoided as a result. In this case, it is particularly advantageous that, during the time in which only the emergency power supply is available for the lock with a rotary latch for a motor vehicle, the rotary latch itself remains in the open position, as a result of which the door of the motor vehicle can always be opened and a locking of the lock during this time is therefore prevented. This procedure noticeably enhances the safety precautions.

A preferred refinement of the invention resides in the second, self-locking actuator being activated in a following step by the main power supply until the self-locking action is canceled and the pawl passes into the closed position because of the spring force of a pawl spring. This step is carried out if the main power supply is available again for the lock with a rotary latch for a motor vehicle. As a result, it is no longer necessary to keep the pawl in the open position. The second, self-locking actuator is then activated directly by the power supply and therefore loses its self-locking action, which was able previously to keep the pawl in the open position in order to improve the safety precautions. It is advantageous in this case that the position of the rotary latch can be adapted to the emergency situation, which is lessened at this time. It is then namely possible again, by insertion of the locking bolt into the rotary latch, to obtain a locking of the lock with a rotary latch for a motor vehicle, which is entirely desirable at this time.

According to a first preferred refinement of the invention, the emergency power supply takes place by means of a capacitor. The capacitor used in this case is particularly advantageously a gold cap as sold, for example, by Panasonic. On account of its high capacitance, a capacitor of this type is particularly advantageously suitable as a bridging-over voltage supply.

BRIEF DESCRIPTION OF THE SEVERAL VIEWS OF THE DRAWINGS

The invention is explained in greater detail and by way of example below with reference to the drawing (FIGURE).

DETAILED DESCRIPTION OF THE INVENTION

The FIGURE shows part of the lock with a rotary latch for a motor vehicle in plan view.

The figure illustrates part of the lock with a rotary latch 2 for a motor vehicle in plan view. In the method for actuating a pawl 1, in a lock with a rotary latch 2 for a motor vehicle, in the normal situation first of all the pawl 1, which is in the closed position and is mounted rotatably about a pivot 3, is caused to rotate by a first actuator 4, which is activated by a main power supply 11, and by a gearwheel segment 5, which is likewise mounted rotatably about the pivot 3 and runs freely in relation to the pawl 1, This takes place until the open position (not illustrated) is reached. In this case, the first actuator 4 is activated by the main power supply 11 via a line 11'. The actuator 4 is connected to the gearwheel segment 5 via a first pinion 4'. In the closed position (shown in the figure) of the lock with a rotary latch 2 for a motor vehicle, the pawl 1 is prestressed by a pawl spring 10 and the rotary latch 2 by a rotary latch spring 12. If, in the event of an emergency, the main power supply 11 fails, then a second, self-locking actuator 6 is activated by an emergency power supply 7. The second, self-locking actuator 6 is connected via a second pinion 6' to a further, rotatably mounted gearwheel segment 8 which bears a gearwheel 9 having a smeller diameter. The gearwheel 9 engages directly in the gearwheel segment 5. The emergency power supply 7 thus makes it possible for the pawl 1 to be actuated in the event of an emergency until the open position is realized. The emergency power supply 7 is then interrupted and the pawl 1 is kept in the open position. This takes place by means of the self-locking action of the second, self-locking actuator 6 which, after the emergency power supply 7 is switched off, remains in its position and thus keeps the pawl 1 in the open position. In this case, the activation of the second, self-locking actuator 6 by means of the emergency power supply 7 takes place by the further line 7'. If the main power supply 11 is again available after some time, then the second, self-locking actuator 6 is directly activated by the main power supply 11 via the second line 11", as a result of which the self-locking action is canceled. The spring force of the pawl spring 10 then advantageously enables the pawl 1 to pass into the closed position, so that the door can be closed again by insertion of the closing bolt 14 into to rotary latch 2. Electric motors are advantageously used as the first actuator 4 and as the second, self-locking actuator 6. A capacitor can advantageously be used as the emergency power supply 7. The particular position of the rotary latch 2 can additionally be detected and monitored at all times with the aid of a rotary latch switch 13. This information can be used to optimize the activation of the main power supply 11 or emergency power supply 7.

What is claimed is:

1. A method for actuating a pawl in a lock with a rotary latch for a motor vehicle, comprising the steps of:

rotating the pawl, until the open position is reached, by a first actuator which is activated by a main power supply and by a gearwheel segment, the pawl arranged such that in a normal situation the pawl is in a closed position and mounted rotatably about a pivot, and the gearwheel segment is mounted rotatably about the pivot so as to run freely in relation to the pawl, or in the event of an emergency, causing the pawl to rotate by a second, self-locking actuator, which is activated by an emergency power supply, via a further, rotatably mounted gearwheel segment which bears a gearwheel having a smaller diameter and which engages in the gearwheel segment until the open position is reached and then the emergency power supply is interrupted so that the pawl remains in the open position, and wherein the emergency power supply is effected by means of a capacitor.

2. The method according to claim 1, further comprising the step of activating the second, self-locking actuator by the main power supply until the self-locking action is canceled and the pawl passes into a closed position because of spring force of a pawl spring.

3. The method according to claim 2, wherein the emergency power supply is effected by means of a capacitor.

* * * * *